US008006661B2

(12) United States Patent
Palumbo

(10) Patent No.: US 8,006,661 B2
(45) Date of Patent: Aug. 30, 2011

(54) BRIDGE AND PIVOT FOOT ARRANGEMENT FOR OPERATING ENGINE CYLINDER VALVES

(75) Inventor: Christofer J. Palumbo, Elmwood Park, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 184 days.

(21) Appl. No.: 12/534,956

(22) Filed: Aug. 4, 2009

(65) Prior Publication Data

US 2011/0030634 A1 Feb. 10, 2011

(51) Int. Cl.
*F01L 1/26* (2006.01)

(52) U.S. Cl. ..... 123/90.22; 123/90.39; 123/90.61; 29/888.2; 74/559; 74/569

(58) Field of Classification Search ..... 123/90.22, 123/90.39, 90.61; 29/888.2; 74/559, 567, 74/569

See application file for complete search history.

(56) References Cited

U.S. PATENT DOCUMENTS 5,038,726 A 8/1991 Pryba
5,410,995 A 5/1995 Bentz
5,988,134 A 11/1999 Smietanski
5,992,018 A 11/1999 Reiter
6,273,042 B1 8/2001 Perez
6,354,257 B1 3/2002 Marshall et al.
6,484,683 B2 11/2002 Zielke
7,237,519 B2 * 7/2007 Wang et al. ..... 123/90.39

OTHER PUBLICATIONS

International Search Report for PCT US2010/041460 dated Sep. 3, 2010.
Written Opinion of the International Searching Authority for PCT US2010/041460 dated Sep. 3, 2010.

* cited by examiner

*Primary Examiner* — Ching Chang
(74) *Attorney, Agent, or Firm* — Jack D. Nimz; Jeffrey P. Clafa

(57) ABSTRACT

An internal combustion engine has one or more engine cylinders (12) within which fuel is combusted and a pair of cylinder valves (14, 16) spring-biased (22, 24) closed but open in unison to place the respective cylinder in flow communication with one of an intake and an exhaust. A bridge (34) bridges ends of the pair external to the cylinder and has a spherically concave depression (42) in a face that is opposite a face that bears against the ends of the pair. The depression is located intermediate locations at which the ends of the pair bear against the bridge. A pivot foot (44) has a spherically convex surface (46) seated with substantial conformity in the depression and a flat surface (48) opposite the spherically convex surface. The flat surface of the pivot foot abuts a flat surface (50) of a rocker (30) that when rocked acts through the pivot foot and bridge to open the respective pair of valves.

7 Claims, 2 Drawing Sheets

BRIDGE AND PIVOT FOOT ARRANGEMENT FOR OPERATING ENGINE CYLINDER VALVES

TECHNICAL FIELD

The subject matter of this disclosure relates to internal combustion engines. In particular the disclosure relates to a bridge and an associated pivot foot through which a rocker operates a pair of cylinder poppet valves, either intake or exhaust valves, in unison.

BACKGROUND OF THE DISCLOSURE

Certain internal combustion engines comprise multi-valve cylinders. In such an engine more than one intake valve and/or more than one exhaust valve per cylinder are present. Because a pair of exhaust valves for a cylinder or a pair of intake valves for a cylinder typically operate concurrently, a known valvetrain comprises a bridge between the valves of each such pair.

A lobe on a rotary camshaft periodically opens a pair of valves in unison via a lifter and pushrod acting on one end of a rocker that is mounted on the engine head to rock back and forth about an axis. The opposite end of the rocker acts on the valves via the bridge and an associated pivot foot.

When the cam lobe moves the pushrod upward, the rocker rocks, causing the pivot foot to act on the bridge and force the valves open, consequently opening the cylinder for intake flow in the case of intake valves or for exhaust flow in the case of exhaust valves.

SUMMARY OF THE DISCLOSURE

The present disclosure relates to a novel arrangement of a rocker, a pivot foot, and a bridge for operating a pair of engine cylinder poppet valves. The arrangement can improve access of mutually abutting surface of these parts to lubricating oil that is delivered by an engine's lubricating system onto moving parts of the valvetrain mechanism in the vicinity of the rocker.

The parts can also be economically fabricated and assembled into an engine.

A general aspect of this disclosure relates to an internal combustion engine comprising one or more engine cylinders within which fuel is combusted to nm the engine and a pair of cylinder valves associated with each cylinder that are spring-biased closed but are operated open in unison to place the respective cylinder in flow communication with one of an intake through which intake flow can enter the respective cylinder and an exhaust through which exhaust flow can exit the respective cylinder.

A mechanism for operating each pair of cylinder valves open in unison comprises a bridge that bridges ends of the respective pair external to the respective cylinder. The bridge comprises a spherically concave depression in a face that is opposite a face that bears against the ends of the respective pair. The depression is located intermediate locations at which the ends of the respective pair bear against the bridge. A pivot foot has a spherically convex surface seated with substantial conformity in the depression and a flat surface that is opposite the spherically convex surface. The flat surface of the pivot foot is in abutment with a flat surface of a rocker that when rocked by a pushrod is effective to act through the pivot foot and bridge to open the respective pair of valves.

Another general aspect relates to a method of making a valvetrain of an internal combustion engine having one or more engine cylinders within which fuel is combusted to nm the engine and a pair of cylinder valves that are associated with each of one or more of the cylinders and that are spring-biased closed but are operated open in unison to place the respective cylinder in flow communication with one of an intake through which intake flow can enter the respective cylinder and an exhaust through which exhaust flow can exit the respective cylinder.

The method comprises fabricating a metal bridge for bridging ends of the respective pair external to a respective cylinder to create in one face of the bridge a pair of blind holes for receiving the ends of valves and in an opposite face a spherically concave depression intermediate the blind holes, fabricating a pivot foot that has a spherically convex surface whose radius substantially conforms to that of the depression, placing the spherically convex surface of the pivot foot in surface-to-surface contact with the spherically concave depression, placing the bridge to receive the ends of the valves in the blind holes, and placing the flat surface of the pivot foot in surface-to-surface contact with a flat surface of a rocker that is effective to open the valves in unison via the pivot foot and the bridge.

The foregoing summary, accompanied by further detail of the disclosure, will be presented in the Detailed Description below with reference to the following drawings that are part of this disclosure.

DETAILED DESCRIPTION

Figure 1:
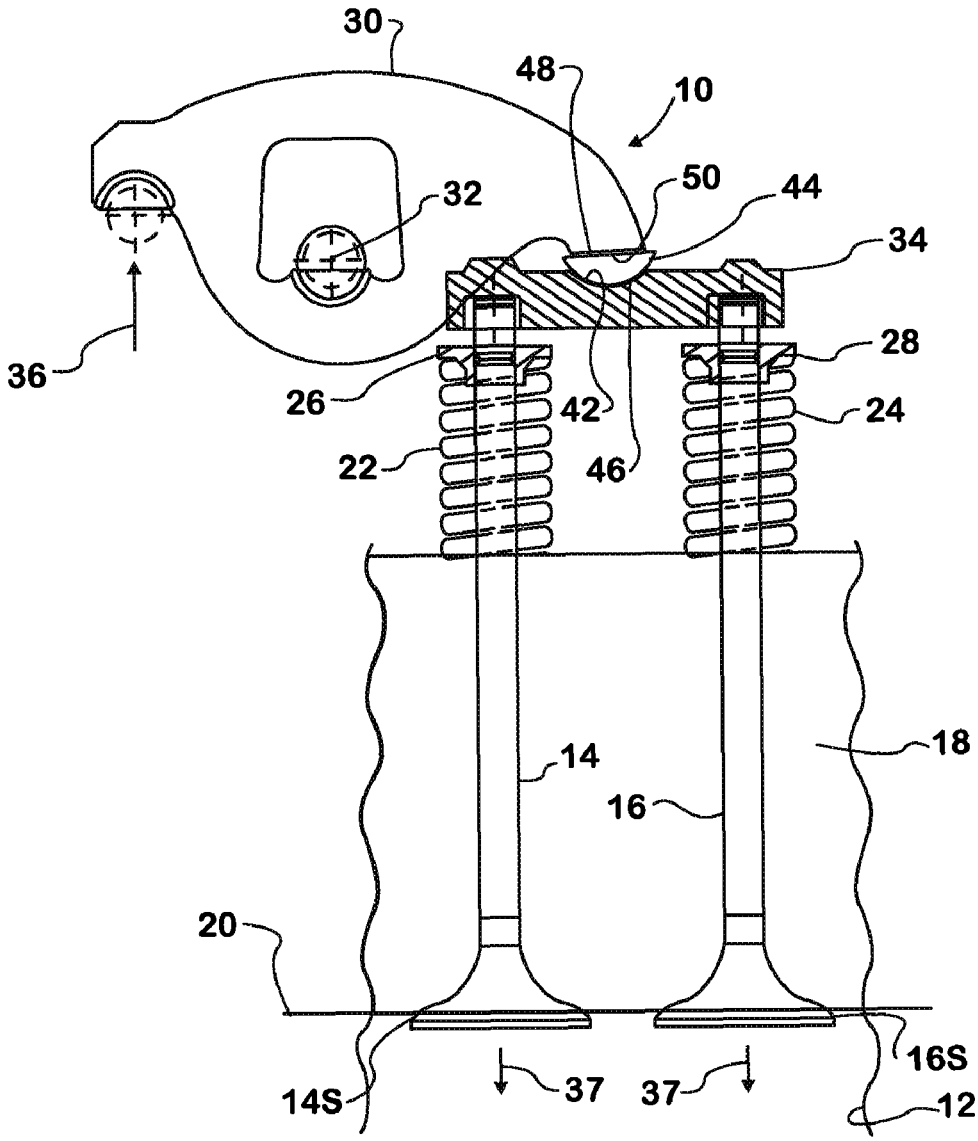
FIG. 1 is a view of a portion of a valvetrain for operating cylinder valves of an engine.

FIG. 1 illustrates a portion of an internal combustion engine's valvetrain 10 that is associated with a multi-valve engine cylinder 12.

A piston (not shown) is arranged for reciprocation within cylinder 12. A connecting rod (also not shown) couples the piston to a crankshaft (not shown). When combustion occurs within cylinder 12, the piston is forced downward causing the connecting rod to apply torque to the crankshaft thereby operating the engine.

FIG. 1 shows two cylinder valves 14, 16 that can be either intake or exhaust valves and that operate in unison. The valves are mounted in a head 18 suitably fastened and sealed to a block 20 that has a crankcase containing the crankshaft so that the head and block cooperatively form cylinder 12 along with forming other cylinders of a multi-cylinder engine. Each valve 14, 16 is a poppet-type valve that is biased closed on a respective valve seat 14S, 16S by a respective valve spring 22, 24 that acts between head 18 and a respective valve retainer 26, 28.

Other components that are conventionally associated with cylinder 12 and valves 14 and 16, such as a fuel injector and valve guides are not specifically shown, and valve seats 14S, 16S are not shown in detail.

Valvetrain 10 is operated by a camshaft (not shown) that is coupled with and rotated by the crankshaft. Rotation of the camshaft is effective via a corresponding cam lobe to periodically open valves 12, 14 in unison via a lifter and pushrod acting on one end of a rocker 30 that is mounted on head 18 for rocking back and forth about an axis 32. The opposite end of rocker 30 acts on the valves via a valve bridge 34.

When the cam lobe moves pushrod upward, the pushrod pushes on the left hand end of rocker 30 as suggested by arrow 36, it rocks the rocker clockwise about axis 32, forcing the right hand end of the rocker downward. The rocker in turn forces bridge 34 downward, and the bridge in turn forces valves 14, 16 downward as suggested by arrows 37, unseating each from the respective valve seat 14S, 16S and consequently opening cylinder 12 either to intake flow in the case of intake valves or to exhaust flow in the case of exhaust valves. It should be understood that for illustrative convenience and clarity, FIG. 1 shows rocker 30 and axis 32 90° out of position relative to cylinder 12 and valves 14, 16.

Figure 3:
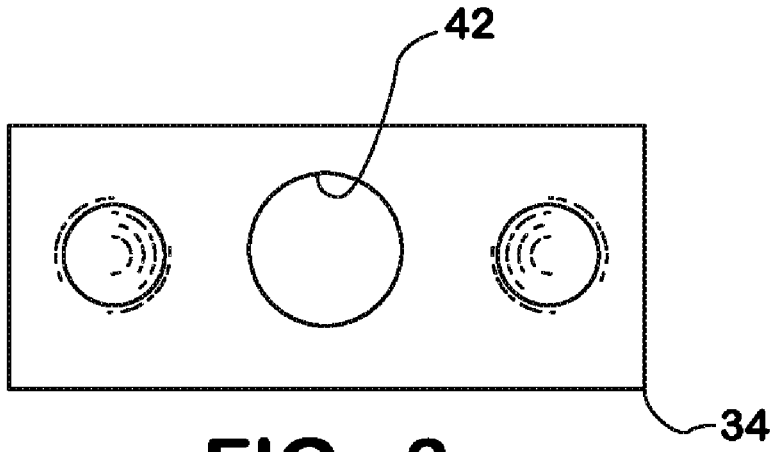
FIG. 3 is a top view of one of the parts, namely a bridge, shown in the previous Figures.
Figure 2:
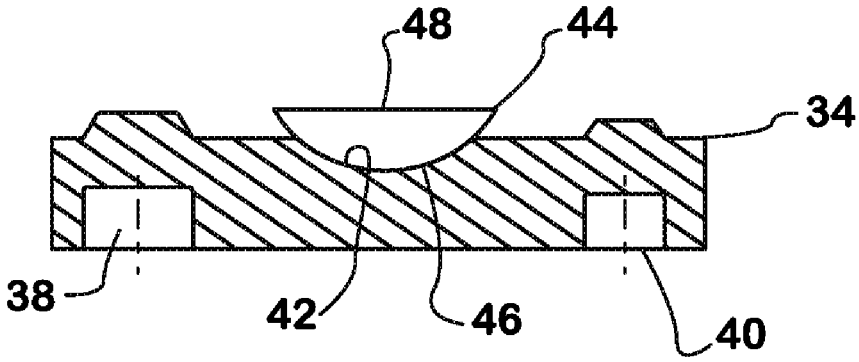
FIG. 2 is an enlarged view of a portion of FIG. 1.
Figure 4:
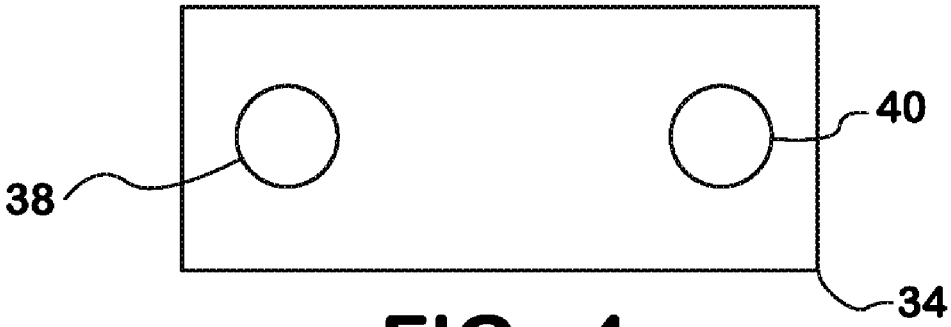
FIG. 4 is a bottom view of the bridge shown in FIG. 3.

FIG. 2-4 show more detail of bridge 34. It has a generally rectangular shape and comprises a metal having suitable hardness and wear properties. Upsets 38, 40 are cold-formed in the face that confronts the ends of the stems of valves 14, 16 to form blind holes located to receive the stem ends when valvetrain 10 is being assembled. A spherically concave depression 42 is cold-formed in the opposite face midway intermediate upsets 38, 40.

FIG. 1 shows a pivot foot 44 disposed between the right hand end of rocker 30 and bridge 34. Pivot foot 44 is an element of suitable hardness having a spherically contoured convex surface 46 and an adjoining flat circular surface 48 whose radius is less than the radius of the spherical contour of surface 46. The spherical radius of surface 46 is substantially equal to that of depression 42.

In valvetrain 10, surface 46 seats in depression 42 with substantial conformity and surface 48 bears against a flat surface 50 of rocker 30. When valves 14, 16 are closed, both surface 48 and surface 50 incline upwardly at a relatively small acute angle as shown in FIG. 1. As rocker 30 turns clockwise from the position shown, the inclination changes and ultimately becomes slightly downwardly when the valves are fully open. A lubrication system of the engine delivers lubricating oil to moving parts of valvetrain 10, including rocker 30, pivot foot 44 and bridge 34. Oil on rocker 30 can run down under force of gravity onto surface 48 and the top face of bridge 34 facilitating lubrication between the mutually abutting surfaces 48, 50 of the pivot foot and rocker and the mutually abutting surfaces of the bridge and pivot 44.

Because bridge 34 can present a wide face to rocker 30, the diameter of depression 42 at that face can be made large and provide large surface area contact between pivot foot 44 and bridge 34 to aid in reducing wear and in facilitating the cold-forming of depression 42. The depth of depression 42 and its spherical radius should be chosen to provide substantially even pressure distribution while seeking to minimize the maximum height of the pivot foot for good stability of the pivot foot between the rocker and bridge (avoid walking out).

The disclosed embodiment offers potential cost savings through the use of manufacturing processes that include making pivot foot 44 from a hardened ball, cold-forming of the bridge features and making a flat wear surface on rocker 30 for abutting the pivot foot.

Balls are essentially inexpensive commodities that possess useful characteristics of high hardness and good finish, characteristics that are useful in the other parts as well. The disclosed pivot foot 44 can be fabricated by cutting a ball across a plane to create a cap that can be used as the pivot foot.

With greater surface-to-surface contact areas that are more accessible to lubricating oil being dispensed onto the mechanism, it may be possible to avoid the use of special coatings or special materials and the typical higher cost of such refinements.

It is possible for the flat surface 48 that results from cutting a hardened ball to create the cap to be left without further treatment because it will be the hardened spherical surface 46 that will be more prone to higher wear stress.

Similarly, the surface of depression 42 may be left untreated after cold-forming A slight degree of roughness in the depression's surface can perform as a good wear surface when the mating surface is smooth, as is surface 46 of the cap. That slight roughness can promote good lubrication because the microscopic low points will contain lubricating oil.

However, both the pivot foot and bridge may be fabricated by other manufacturing processes. For example, the pivot foot may be fabricated by cold-forming.

What is claimed is:

1. An internal combustion engine comprising:

one or more engine cylinders within which fuel is combusted to run the engine;

a pair of cylinder valves associated with each cylinder that are spring-biased closed but when operated open place the respective cylinder in flow communication with one of an intake through which intake flow can enter the respective cylinder and an exhaust through which exhaust flow can exit the respective cylinder; and a mechanism for operating each pair of cylinder valves in unison comprising a bridge that bridges ends of the respective pair external to the respective cylinder and comprises a spherically concave depression in a face that is opposite a face that bears against the ends of the respective pair of cylinder valves, the depression being located intermediate locations at which the ends of the respective pair of cylinder valves bear against the bridge, a pivot foot that has a spherically convex surface seated with substantial conformity in the spherical concave depression and a flat surface that is opposite the spherically convex surface, the flat surface of the pivot foot being in abutment with a flat surface of a rocker that when rocked by a pushrod is effective to act through the pivot foot and the bridge to open the respective pair of valves.

2. An engine as set forth in claim 1 in which the spherically convex surface and the flat surface of the pivot foot that is opposite the spherically convex surface collectively form the cap of a sphere.

3. An engine as set forth in claim 2 in which the bridge comprises upsets forming blind holes for receiving the ends of valves.

4. A method of making a valvetrain of an internal combustion engine having one or more engine cylinders within which fuel is combusted to run the engine and a pair of cylinder valves that are associated with each of one or more of the cylinders and that are spring-biased closed but are operated open in unison to place the respective cylinder in flow communication with one of an intake through which intake flow can enter the respective cylinder and an exhaust through which exhaust flow can exit the respective cylinder, the method comprising fabricating a metal bridge for bridging ends of the respective pair of cylinder valves external to a respective cylinder to create in one face of the bridge a pair of blind holes for receiving the ends of valves and in an opposite face a spherically concave depression intermediate the blind holes, fabricating a pivot foot that has a spherically convex surface whose radius substantially conforms to that of the spherical concave depression, placing the spherically convex surface of the pivot foot in surface-to-surface contact with the spherically concave depression, placing the bridge to receive the ends of the valves in the blind holes, and placing the flat surface of the pivot foot in surface-to-surface contact with a flat surface of a rocker that is effective to open the valves in unison via the pivot foot and the bridge.

5. A method as set forth in claim 4 in which the step of fabricating a metal bridge comprises cold-forming the bridge.

6. A method as set forth in claim 4 in which the step of fabricating a pivot foot comprises cold-forming the pivot foot.

7. A method as set forth in claim 4 in which the step of fabricating a pivot foot comprises cutting a cap from a metal ball and using the cap as the pivot foot.

* * * * *